US008562395B2

(12) United States Patent
Boeck et al.

(10) Patent No.: US 8,562,395 B2
(45) Date of Patent: Oct. 22, 2013

(54) GUARD ANTI-ROTATION LOCK

(75) Inventors: Cornelius Boeck, Kirchheim (DE); Joachim Schadow, Leinfelden-Echterdingen (DE); Sinisa Andrasic, Schoenaich (DE)

(73) Assignee: Robert Bosch GmbH, Stuttgart (DE)

( * ) Notice: Subject to any disclaimer, the term of this patent is extended or adjusted under 35 U.S.C. 154(b) by 404 days.

(21) Appl. No.: 12/282,828

(22) PCT Filed: Nov. 9, 2007

(86) PCT No.: PCT/EP2007/062134
§ 371 (c)(1),
(2), (4) Date: Sep. 12, 2008

(87) PCT Pub. No.: WO2008/058909
PCT Pub. Date: May 22, 2008

(65) Prior Publication Data

US 2009/0098812 A1 Apr. 16, 2009

(30) Foreign Application Priority Data

Nov. 13, 2006 (DE) ..... 10 2006 053 305

(51) Int. Cl.
*B24B 55/04* (2006.01)

(52) U.S. Cl.
USPC ..... 451/451; 451/359; 451/452; 451/453

(58) Field of Classification Search
USPC ..... 451/344, 353, 359, 451, 452, 453
See application file for complete search history.

(56) References Cited

U.S. PATENT DOCUMENTS

| | | | | |
|---|---|---|---|---|
| 4,060,940 | A * | 12/1977 | DeWitt | 451/358 |
| 4,574,532 | A * | 3/1986 | Haberle et al. | 451/451 |
| 4,791,541 | A * | 12/1988 | Simmons | 362/376 |
| 4,924,635 | A * | 5/1990 | Rudolf et al. | 451/344 |
| 5,005,321 | A * | 4/1991 | Barth et al. | 451/359 |
| 5,384,985 | A * | 1/1995 | Jacobsson | 451/344 |
| 5,440,815 | A * | 8/1995 | Inkster | 30/390 |
| 5,766,062 | A * | 6/1998 | Edling | 451/451 |
| 6,464,573 | B1 * | 10/2002 | Keller | 451/451 |
| 6,669,544 | B1 * | 12/2003 | Walz et al. | 451/454 |
| 6,699,114 | B1 * | 3/2004 | Booeshaghi et al. | 451/451 |
| 6,893,334 | B1 * | 5/2005 | Stivers | 451/359 |
| 6,949,017 | B2 * | 9/2005 | Koschel et al. | 451/358 |
| 6,988,939 | B2 * | 1/2006 | Hofmann et al. | 451/344 |
| 7,063,606 | B2 * | 6/2006 | Stierle et al. | 451/359 |

(Continued)

FOREIGN PATENT DOCUMENTS

| | | |
|---|---|---|
| DE | 36 36 601 | 5/1988 |
| DE | 37 42 430 | 6/1989 |

(Continued)

*Primary Examiner* — Eileen P. Morgan
(74) *Attorney, Agent, or Firm* — Michael J. Striker

(57) ABSTRACT

A system for a hand-held power tool has a tool housing, a receiving unit fixed to the tool housing and a guard unit connected with the hand-held power tool. The guard unit includes a guard extending at least partially around a rotatable tool. A guard anti-rotation lock device includes a clamping band fixedly connected to the guard that establishes a frictional connection between the guard unit and the receiving unit. The receiving unit includes a receiving flange and a connecting element that are together surrounded by and clamped in a clamping region by the clamping band to effect the frictional connection. In a case where the rotatable tool bursts into pieces during operation, the connecting element counteracts rotational movement of the guard unit with respect to the receiving unit by changing a cross-sectional shape of the clamping region.

11 Claims, 8 Drawing Sheets

(56) References Cited

U.S. PATENT DOCUMENTS

| | | | | |
|---|---|---|---|---|
| 7,175,513 | B2 | 2/2007 | Folin | |
| 7,311,589 | B2 * | 12/2007 | Wiker | 451/451 |
| 2004/0014412 | A1 * | 1/2004 | Hofmann et al. | 451/451 |
| 2006/0052041 | A1 * | 3/2006 | Wiker | 451/451 |

FOREIGN PATENT DOCUMENTS

| | | |
|---|---|---|
| DE | 90 10 138 | 9/1990 |
| DE | 44 22 247 | 1/1996 |
| DE | 296 01 002 | 5/1997 |
| DE | 101 15 635 | 10/2002 |
| EP | 0 812 657 | 12/1997 |
| EP | 0 978 353 | 2/2000 |
| EP | 1 522 390 | 4/2005 |
| EP | 1 618 990 | 1/2006 |
| RU | 2 152 862 | 7/2000 |
| SU | 301270 | 1/1971 |
| SU | 495 192 | 12/1975 |
| SU | 1611615 | 12/1990 |
| WO | 2004/087377 | 10/2004 |

* cited by examiner

GUARD ANTI-ROTATION LOCK

CROSS-REFERENCE TO A RELATED APPLICATION

The invention described and claimed hereinbelow is also described in German Application DE 10 2006 053 305.4 filed on Nov. 13, 2006. This German Patent Application, whose subject matter is incorporated here by reference, provide the basis for a claim of priority of invention under 35 USC 119 (a)-(d).

BACKGROUND OF THE INVENTION

The present invention is directed to a guard anti-rotation lock device.

An angle grinder with an adjustable guard is made known in EP 812 657 A1. In that case, the guard is adjustable in a rotating manner on a connection piece of a flange of the angle grinder, and is supported such that it may be detachably attached using a single form-fit locking means. The spindle of the angle grinder passes through the center of the flange. A cutting disk or grinding disk are/is installed on the free end of the spindle in a clampable, rotationally drivable manner for cutting and machining work pieces, which are partially enclosed by the guard. The guard must be positioned in a rotationally adjustable manner on the hand-held power tool such that the region of the grinding disk that faces the user is enclosed by the guard. At the same time, a region of the grinding disk that points away from the user extends past the flange, radially relative to the region of engagement with the work piece.

SUMMARY OF THE INVENTION

The present invention relates to a guard anti-rotation lock device for a hand-held power tool, in particular for an angle grinder, which is provided to prevent rotation between the hand-held power tool and a guard unit.

It is provided that the anti-rotation lock device includes a non-positive connection unit, which is provided to prevent rotation between the hand-held power tool and the guard unit if a tool should burst. The guard unit is preferably provided to protect an operator—during regular operation of the hand-held power tool—from a tool, in particular from a disk-shaped, rotatably drivable tool, and/or from machining residue that is slung in the direction of the operator, or from a tool, in particular from a disk-shaped, rotatably drivable tool, or from machining residue that is slung in the direction of the operator, where the drivable tool is attached to the hand-held power tool in a working position. A "non-positive connection unit" refers, in particular, to a unit that is provided to establish a non-positive connection—that acts in the circumferential direction—between the guard unit and the hand-held power tool, and which is designed—when in an anti-rotation lock position between the guard unit and the hand-held power tool—to absorb forces of an outwardly-slung tool piece that could occur if a tool should burst. To attain an anti-rotation lock of the guard unit on the hand-held power tool, the guard unit, which is attached to the hand-held power tool, may be moved into the anti-rotation lock position by absorbing forces of impulses or forces of outwardly-slung pieces of the burst tool. "Provided" is intended to mean, in particular, specially equipped and/or designed. Due to the inventive design of the guard anti-rotation lock device, it is possible to effectively protect an operator of the hand-held power tool from a tool that rotates during operation of the hand-held power tool, and, in particular, from pieces of the tool that are slung in the direction of the operator if the tool becomes damaged, e.g., if the tool should burst.

In addition, according to the present invention, the non-positive connection unit is provided to establish a non-positive connection between the hand-held power tool and the guard unit by changing at least one shape parameter of a component of the hand-held power tool and/or the guard unit. As a result, advantageously, an increased frictional force may be attained between the guard unit and the hand-held power tool, in particular along contact surfaces for attaching the guard unit to the hand-held power tool if the tool should burst, thereby generating an additional force for fixing the guard unit in position. This may be attained in a particularly advantageous manner when the non-positive connection unit includes at least one non-positive connection element, which is provided to change the shape parameter of the hand-held power tool and/or the guard unit. Preferably, the shape parameter includes a cross-sectional area of a receiving unit of the hand-held power tool, and/or a diameter of a clamping band of the guard unit, and/or further shape parameters that appear reasonable to one skilled in the technical art. A "cross-sectional area of a receiving unit" refers, in particular, to a surface to be enclosed in a circumferential direction by the clamping band in order to attain a non-positive connection between the hand-held power tool and the guard unit.

It is also provided that the non-positive connection element is movably supported on the hand-held power tool and/or the guard unit, thereby making it possible to change the shape parameter using a simple design, in particular if a tool should burst.

If, in addition, the non-positive connection element is movable—together with the guard unit—into an anti-rotation lock position if a tool should burst, it is advantageously possible to change the shape parameter by changing the position—in particular the anti-rotation lock position—of the non-positive connection element. In addition, the energy of a piece of a burst tool that is transferred to the guard may be advantageously used to change the position of the non-positive connection element. An "anti-rotation lock position" refers, in particular, to a position of the guard unit relative to the hand-held power tool in which the guard unit is oriented opposite to a rotation, in particular a direction of rotation of the tool on the hand-held power tool, in particular on a receiving flange.

In an advantageous refinement of the present invention, it is provided that the non-positive connection unit includes a guide element in which the non-positive connection element is movably supported, thereby making it possible to realize a particularly specific motion into an anti-rotation lock position, and to realize a low-wear motion of the non-positive connection element.

Particularly advantageously, the non-positive connection element may be moved—together with the guard unit—into an anti-rotation lock position when the non-positive connection element is provided to be coupled to the guard unit in an at least partially form-fit or non-positive manner. In this context, "couplable" refers, in particular, to a driving—due to an at least partial form-fit connection and/or non-positive connection—of the non-positive connection element when a guard unit that is attached to the hand-held power tool rotates from a working position and into the anti-rotation lock position. The guard unit is rotated from the working position and into the anti-rotation lock position due to a transfer of force or a transfer of an impulse from a piece of a tool that has burst to the guard unit.

Particularly advantageously, the non-positive connection element is designed as a rolling element, and/or an eccentric element, and/or a wedge element, and/or a non-positive element designed as a ramp in a circumferential direction, and/or any other non-positive connection elements that appear reasonable to one skilled in the technical art. As a result, it is advantageously possible to obtain a rotational driving with the guard unit and/or a change to a shape parameter using a simple design. The term "circumferential direction" is intended to mean, in particular, a direction that is oriented essentially parallel to a direction of rotation of the tool during operation of the hand-held power tool or when the guard unit is in an installed state on the hand-held power tool.

When the wedge element also includes a thread that enables attachment to a receiving unit of the hand-held power tool, it is possible to attain—using a simple design—a change in shape of the receiving unit, in particular a receiving flange of the receiving unit, against which the guard unit bears in a state in which it is attached to the hand-held power tool, by widening the receiving unit to attain an anti-rotation lock position via a non-positive connection, if a tool should burst.

In an alternative embodiment of the present invention, a hand-held power tool system with a hand-held power tool, in particular an angle grinder, a guard unit, and a guard anti-rotation lock device are provided, in which case the guard anti-rotation lock device includes a non-positive connection unit, which is provided to prevent rotation between the hand-held power tool and the guard unit if a tool should burst. As a result, it is possible to effectively protect an operator of the hand-held power tool from a tool that rotates during operation of the hand-held power tool, and/or, in particular, from pieces of the tool that are slung in the direction of the operator if the tool becomes damaged, e.g., the tool should burst. To realize an anti-rotation lock of the guard unit on the hand-held power tool, the guard unit, which is attached to the hand-held power tool, may be moved into the anti-rotation lock position by absorbing impulses or forces of outwardly-slung pieces of the burst tool.

It is also provided that the non-positive connection unit includes at least one non-positive connection element, which is provided to change a shape parameter of the hand-held power tool and/or the guard unit. As a result, advantageously, an increased frictional force may be attained—via the non-positive connection element—between the guard unit and the hand-held power tool, in particular along contact surfaces for attaching the guard unit to the hand-held power tool, if the tool should burst, thereby generating an additional force for fixing the guard unit in position. Preferably, the shape parameter includes a cross-sectional area of a receiving unit of the hand-held power tool, and/or a diameter of a clamping band of the guard unit, and/or further shape parameters that appear reasonable to one skilled in the technical art.

When the hand-held power tool also includes a receiving unit in which the non-positive connection element is at least partially supported, it is possible to realize a particularly compact design of the non-positive connecting unit, at least to a certain extent, and/or if the non-positive connection element should become deformed due to a non-positive connection between the guard unit and the hand-held power tool if a tool should burst, then it is particularly easy to replace the non-positive connection element.

It is also provided that the receiving unit is designed slotted at least partially along a circumferential direction, thereby making it possible in a particularly advantageous manner to attain a reversible change in shape of the receiving unit, in particular a change of a cross-sectional area of the receiving unit. Slot-type openings in the receiving unit are preferably located on the receiving unit perpendicularly to the circumferential direction.

It is also provided that the receiving unit includes an intermediate ring on which the non-positive connection element is at least partially located, thereby making it possible to replace the non-positive connection element—using a simple design—if deformation should occur after a non-positive connection between the guard unit and the hand-held power tool if a tool should burst.

A simple design of the non-positive connection element for changing a shape parameter, in particular for reducing a diameter of a clamping band of the guard unit if a tool should burst, may be realized when the guard unit includes at least one closing unit, on which the non-positive connection element is at least partially located. The closing unit is preferably designed as a clamping closing unit and is provided to attach the guard unit to the hand-held power tool, the attachment advantageously taking place via a frictional connection between the clamping band and the hand-held power tool. Particularly advantageously, the non-positive connection element is located in the region of a closing element, e.g., in the region of a clamping screw, a clamping lever, and/or further closing elements that appear reasonable to one skilled in the technical art.

Particularly advantageously, the present invention includes a hand-held power tool for a rotating, preferably disk-shaped tool, with a machine housing that includes a flange or a machine neck, on which a guard—that is composed of sheet metal in particular—is detachably clampable in order to cover the tool. The guard includes a guard body, which is composed of a circular, disk-shaped piece, in particular with an outer edge located at a right angle thereto, and with a central, circular recess, on the edge of which a guard connection piece or collar is formed and that includes an annular clamping band that may be tightened using a clamping means. An anti-rotation lock that acts between the machine neck and the guard is located between the guard and the machine neck and is designed as a profiled structure. The guard may be repeatedly coupled via the clamping band and/or the clamping means in its clamping position in a form-fit and/or non-positive manner with the machine neck, and is therefore capable of being fixed in a non-rotatable position and, to attain a release position, may be disengaged from the form-fit and/or non-positive connection, so that the guard may then be adjusted in a rotational manner.

BRIEF DESCRIPTION OF THE DRAWINGS

Further advantages result from the description of the drawing, below. Exemplary embodiments of the present invention are shown in the drawing. The drawing, the description, and the claims contain numerous features in combination. One skilled in the art will also advantageously consider the features individually and combine them to form further reasonable combinations.

DESCRIPTION OF THE PREFERRED EMBODIMENTS

Figure 1:
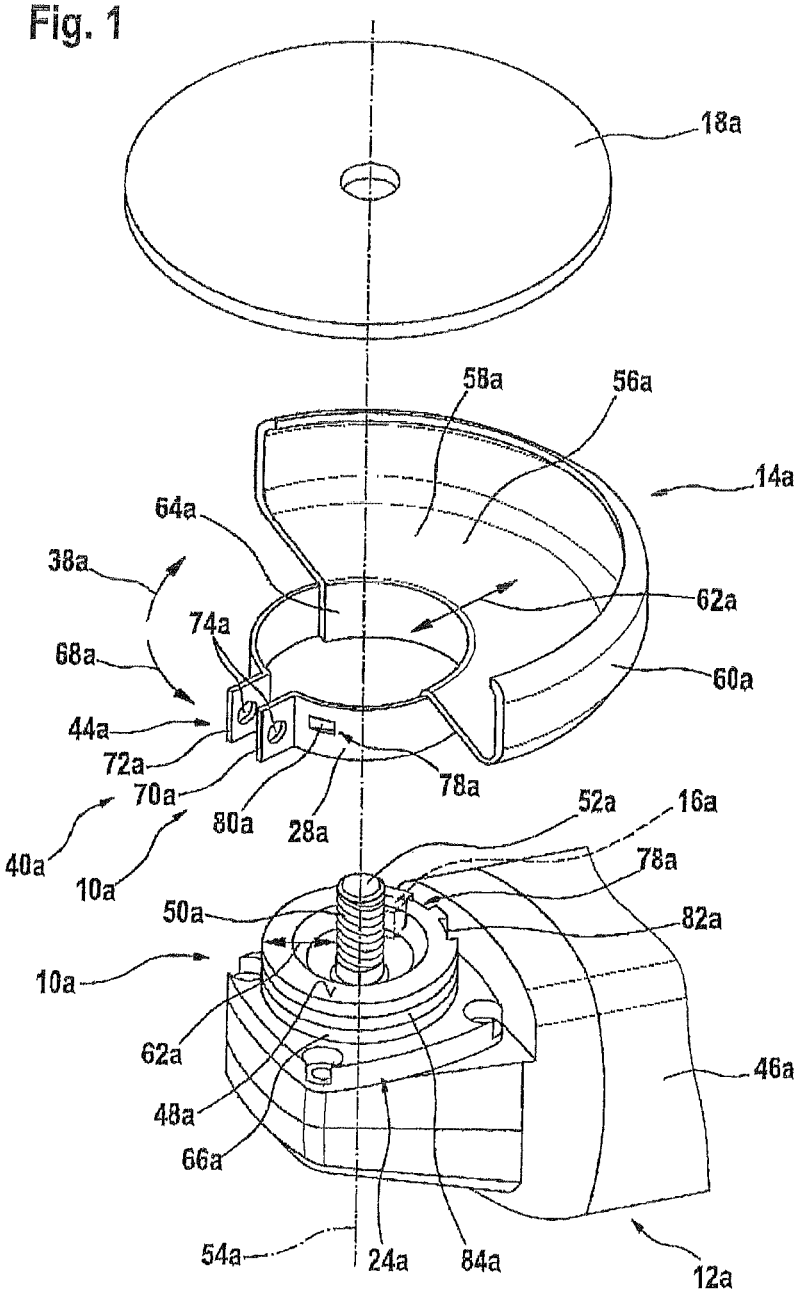
FIG. 1 shows an exploded view of an inventive hand-held power tool system.

FIG. 1 shows a hand-held power tool system 40*a* with a hand-held power tool 12*a* designed as an angle grinder and shown only partially here, and with a guard unit 14*a* and a guard anti-rotation lock device 10*a*. Hand-held power tool 12*a* includes a hand-held power tool housing 46*a*, and a receiving unit 24*a* for receiving guard unit 14 or a tool 18*a* designed as a cutting disk, receiving unit 24*a* being screwed together with hand-held power tool housing 46*a*. A drive shaft 50*a* extends out of receiving unit 24*a* on a side 48*a* facing away from hand-held power tool housing 46*a*. Drive shaft 50*a* is connectable at its free end 52*a* with disk-shaped tool 18*a* and is rotationally drivable around an axis 54*a*. Guard unit 14*a* includes a guard 56*a* and a closing unit 44*a*. When hand-held power tool system 40*a* is in an installed state, guard 56*a* extends around an angular range of tool 18*a* of approximately 180.degree. and, to this end, includes a semi-disk shaped guard body 58*a* and a guard edge 60*a*, which is initially oriented perpendicularly to semi-disk shaped body 58*a* and is finally oriented parallel to semi-disk shaped guard body 58*a*, inwardly in a radial direction 62*a*.

Guard unit 56*a* also includes a guard collar 64*a*, which is oriented essentially perpendicularly to semi-disk shaped guard body 58*a*. Guard collar 64*a* is enclosed outwardly in radial direction 62*a* by a clamping band 28*a* of closing unit 44*a*. Guard collar 64*a* and clamping band 28*a* are interconnected via a welded connection. Guard collar 64*a*—together with clamping band 28*a*—is provided to attach guard unit 14*a* to hand-held power tool 12*a* or to receiving unit 24*a*, which includes a cylindrical receiving flange 66*a* for this purpose. Along a circumferential direction 38*a*, 68*a* of clamping band 28*a*, clamping band 28*a* includes two end regions 70*a*, 72*a* in a region that faces away from guard 56*a* and extends outwardly in radial direction 62*a*. End regions 70*a*, 72*a* each include a recess 74*a*, through which a closing element 76*a*—designed as a clamping screw—of closing unit 44*a* extends (see FIG. 2). The clamping screw may be fastened in recesses 74*a* of the clamping band using a nut. Guard 56*a* is attached in a working position to receiving unit 24*a* or on receiving flange 66*a* via closing unit 44*a* using a frictional connection between guard collar 64*a* and clamping band 28*a* and receiving flange 66*a*, so that guard unit 14*a* is positioned in a non-rotatable manner during regular operation of hand-held power tool 12*a*. In an alternative design of closing unit 44*a*, it is basically feasible to use—instead of the clamping screw—further closing elements, e.g., a clamping lever or form-fit elements, etc.

Hand-held power tool system 40*a* also includes a coding device 78*a*, which is provided to prevent tools 18*a* or tools 18*a* together with guard unit 14*a* from being installed on unsuitable hand-held power tools 12*a*. To this end, clamping band 28*a* includes a coding element 80*a* of coding device 78*a*, which is designed as a single piece with clamping band 28*a*. Coding element 80*a* is designed as a pressed-out region that extends inwardly in radial direction 62*a* and has a rectangular shape. Correspondingly, receiving flange 66*a* includes a coding element 82*a* of coding device 78*a*, which is designed as a recess into which coding element 80*a* of clamping band 28*a* may be inserted when guard unit 14*a* is installed on hand-held power tool 12*a*. After guard unit 14*a* has been inserted onto receiving unit 24*a*, guard unit 14*a* may be rotated into a working position. To this end, receiving flange 66*a* includes a groove 84*a* that extends in circumferential direction 38*a*, 68*a*, in which coding element 80*a* is guided when guard unit 14*a* is rotated into the working position.

Figure 2:
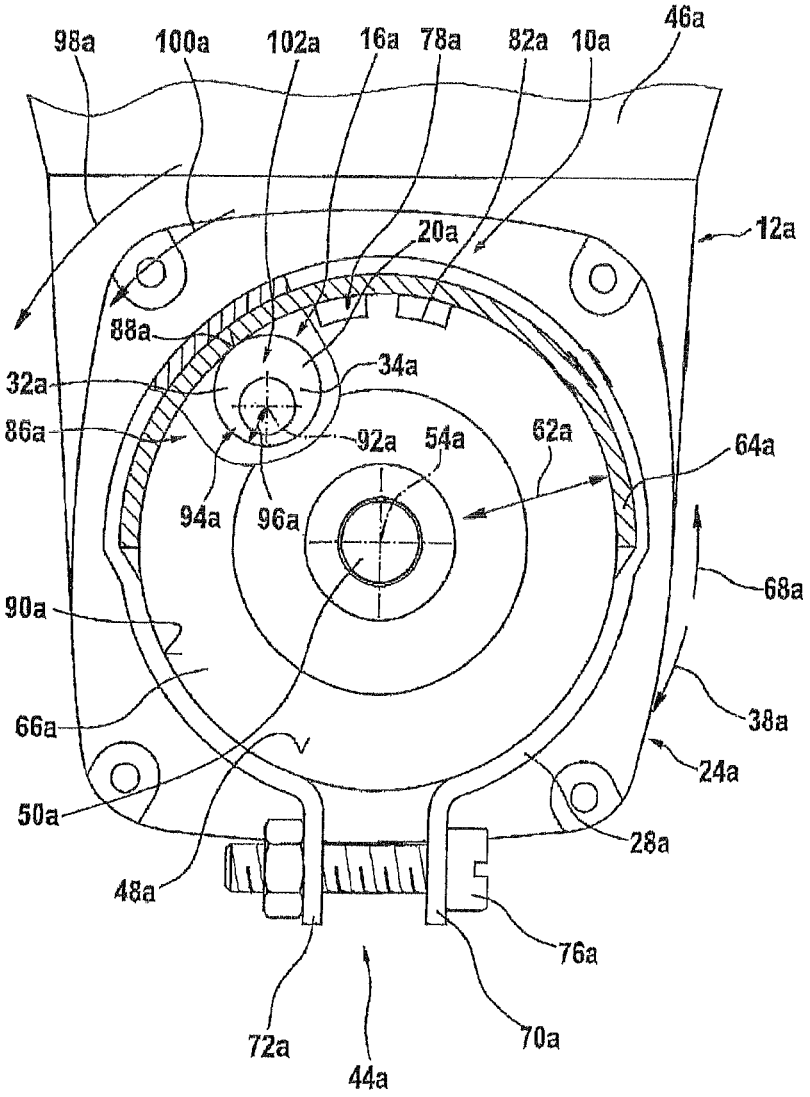
FIG. 2 shows a guard anti-rotation lock device with a non-positive connection element designed as an eccentric element, in a schematic, partial cross-sectional view.

FIG. 2 shows guard anti-rotation lock device 10*a* in FIG. 1 in greater detail. Guard anti-rotation lock device 10*a* is provided to prevent rotation between guard unit 14*a* and hand-held power tool 12*a* or receiving unit 24*a* during a breakdown of tool 18*a*, e.g., when a tool 18*a* bursts. To this end, guard anti-rotation lock device 10*a* includes a non-positive connection unit 16*a*, which is provided to prevent rotation—via a non-positive connection—between hand-held power tool 12*a* and guard unit 14*a* if a tool 18*a* should burst. A non-positive connection is established between hand-held power tool 12*a* and guard unit 14*a* by changing a shape parameter of a component of hand-held power tool 12*a* designed as a receiving flange 66*a*. The shape parameter is designed as a cross-sectional area of receiving unit 24*a* or receiving flange 66*a* to be enclosed by clamping band 28*a* in circumferential direction 38*a*, 68*a*. Cross-sectional area extends essentially perpendicularly to axis 54*a* of drive shaft 50*a*. To this end, receiving unit 24*a* includes a non-positive connection element 20*a* of non-positive connection unit 16*a*, which is provided to change cross-sectional area of receiving flange 66*a*.

To change cross-sectional area, non-positive connection element 20*a* is designed as a cylindrical rolling element 32*a*, and it is movably supported in receiving flange 66*a* in an edge region 86*a* of receiving flange 66*a* located outwardly in radial direction 62*a*. Non-positive connection element 20*a* couples in a non-positive manner to clamping band 28*a* or guard collar 64*a* of guard unit 14*a*. A side 88*a* of rolling element 32*a* that points outwardly in radial direction 62*a* when guard unit 14*a* is in an installed working position on hand-held power tool 12*a* hears against a surface 90*a*—that faces inwardly in radial direction 62*a*—of clamping band 28*a* or of guard collar 64*a* of guard unit 14*a*. In addition, non-positive connection element 20*a* is designed as an eccentric element 34*a*, and it is supported in receiving flange 66*a* such that it may rotate around a rotation axis 92*a*, which is oriented essentially parallel to axis 54*a* of drive shaft 50*a*. During regular operation of hand-held power tool system 40*a*, a subregion 94*a* of eccentric element 34*a* bears against clamping band 28*a* or guard collar 64*a* that is located the shortest distance 96*a* away from rotational axis 92*a*.

If a tool 18*a* should burst during operation of hand-held power tool 12*a*, tool pieces are slung outwardly in a rotation direction 98*a* of tool 18*a*. If one of these tool pieces strikes guard unit 14*a*, the kinetic energy of the tool piece transferred to guard unit 14*a* exceeds the attachment energy of the frictional connection of closing unit 44*a* between guard unit 14*a* and hand-held power tool 12*a*. Guard unit 14*a* is then rotated out of its working position and in rotation direction 98*a* of tool 18*a*. Eccentric element 34*a*, which couples on surface 90*a*—which faces inward in radial direction 62*a*—of clamping band 28*a* or guard collar 64*a* in a non-positive manner, is rotated around rotation axis 92*a* in direction 100*a*, which is oriented in rotation direction 98*a* of tool 18*a*. Due to a motion of guard unit 14*a*, eccentric element 34*a* walks around clamping band 28*a* or guard collar 64, so that eccentric element 34*a* is moved together with guard unit 14*a*. In addition, it is also feasible for surface 90*a*—which faces inwardly in radial direction 62*a*—of clamping band 28*a* or guard collar 64*a*, or an outer surface of eccentric element 34*a* to have a high friction coefficient in order to increase a non-positive connection between eccentric element 34*a* and clamping band 28*a* or guard collar 64*a* due to a special material selection or a special surface treatment.

Due to the rotation of eccentric element 34*a*, a subregion 102*a* of eccentric element 34*a* that is located a greater distance 96*a* away from rotation axis 92*a* than is subregion 94*a* with shortest distance 96*a*, is rotated outwardly. As a result, cross-sectional area of receiving flange 66*a* increases and a frictional force between receiving flange 66*a* and clamping band 28*a*—together with guard collar 64*a*—is increased. Kinetic energy transferred from the tool piece to guard unit 14*a* is partially absorbed by the acting frictional force, and, as soon as the frictional force reaches equilibrium with a residual impulse of guard unit 14*a* along rotation direction 98*a*, guard unit 14*a* is held in an anti-rotation lock position.

In a further embodiment of the present invention, it is feasible to increase the number of eccentric elements 34*a* or to change a location of eccentric element 34*a* within receiving flange 66*a* in a manner that appears reasonable to one skilled in the technical art.

Alternative exemplary embodiments are shown in FIGS. 3 through 7*b*. Components, features, and functions that are essentially the same are labelled with the same reference numerals. To distinguish the exemplary embodiments from each other, the reference numerals of the exemplary embodiments are appended with the letters a through f. The description below is essentially limited to the differences from the exemplary embodiment in FIGS. 1 and 2. With regard for the components, features, and functions that remain the same, reference is made to the description of the exemplary embodiment in FIGS. 1 and 2.

Figure 3:
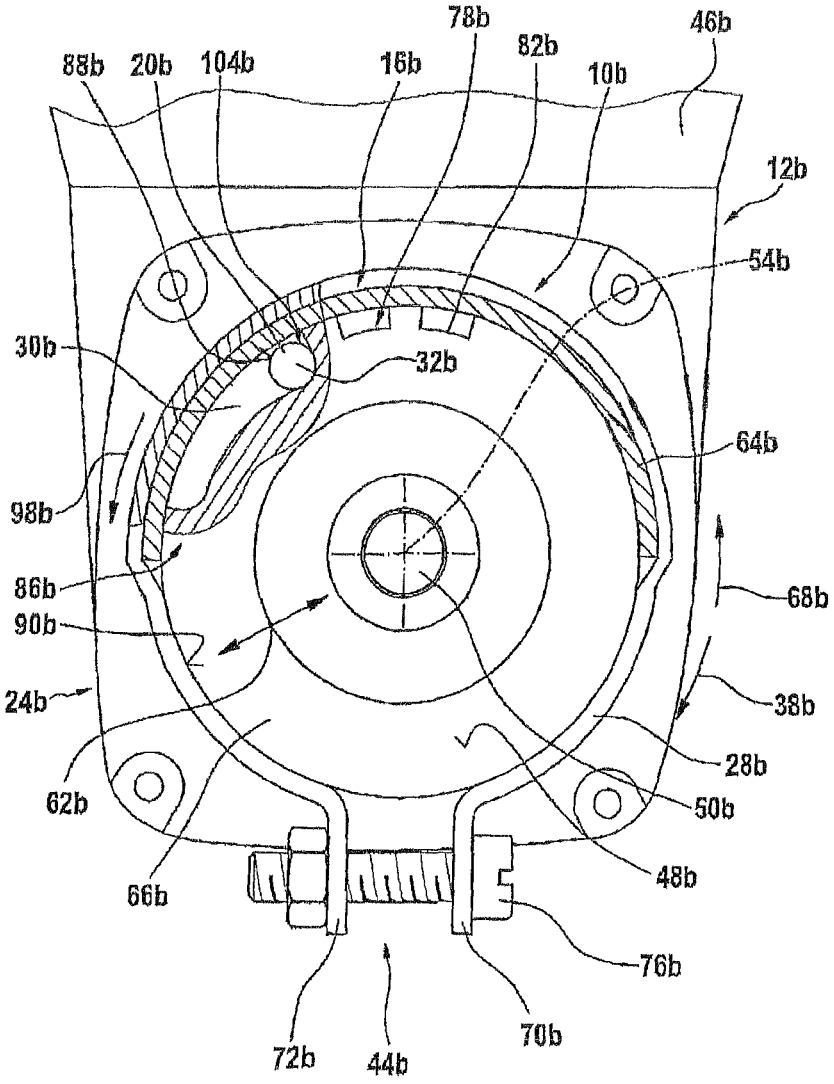
FIG. 3 shows a guard anti-rotation lock device with a non-positive connection element that is movably supported inside a guide element, in a schematic, partial cross-sectional view.

FIG. 3 shows a schematic, partial cross-sectional view of an alternative guard anti-rotation lock device 10*b* of a hand-held power tool system. Guard anti-rotation lock device 10*b* includes a non-positive connection unit 16*b* with a non-positive connection element 20*b*, which is designed as a cylindrical rolling element 32*b*, and which is provided to prevent rotation between a not-shown hand-held power tool and a guard unit if a tool should burst. Non-positive connection unit 16*b* also includes a guide element 30*b*, in which rolling element 32*b* is movably supported. Guide element 30*b* is located in a receiving flange 66*b* in an edge region 86*b*—which is located outwardly in radial direction 62*b*—of receiving flange 66*b*, and it is tapered in design in a rotation direction 98*b* of a tool. Rolling element 32*b* is secured—in an expanded region 104*b* of guide element 30*b* via a not-shown release-prevention mechanism—against being moved in rotation direction 98*b* while the guard unit is changing position or when guard unit is removed. If a frictional force between rolling element 32*b* and a clamping band 28*b* or a guard collar exceeds a retaining force of the release-prevention mechanism, as occurs when the guard unit rotates in rotation direction 98*b* due to a transfer of kinetic energy of an outwardly slung piece of a burst tool, rolling element 32*b* is moved into an anti-rotation lock position along with the guard unit. An anti-rotation lock using non-positive connection element 20*b* is similar to that described with reference to FIG. 2.

Figure 4:
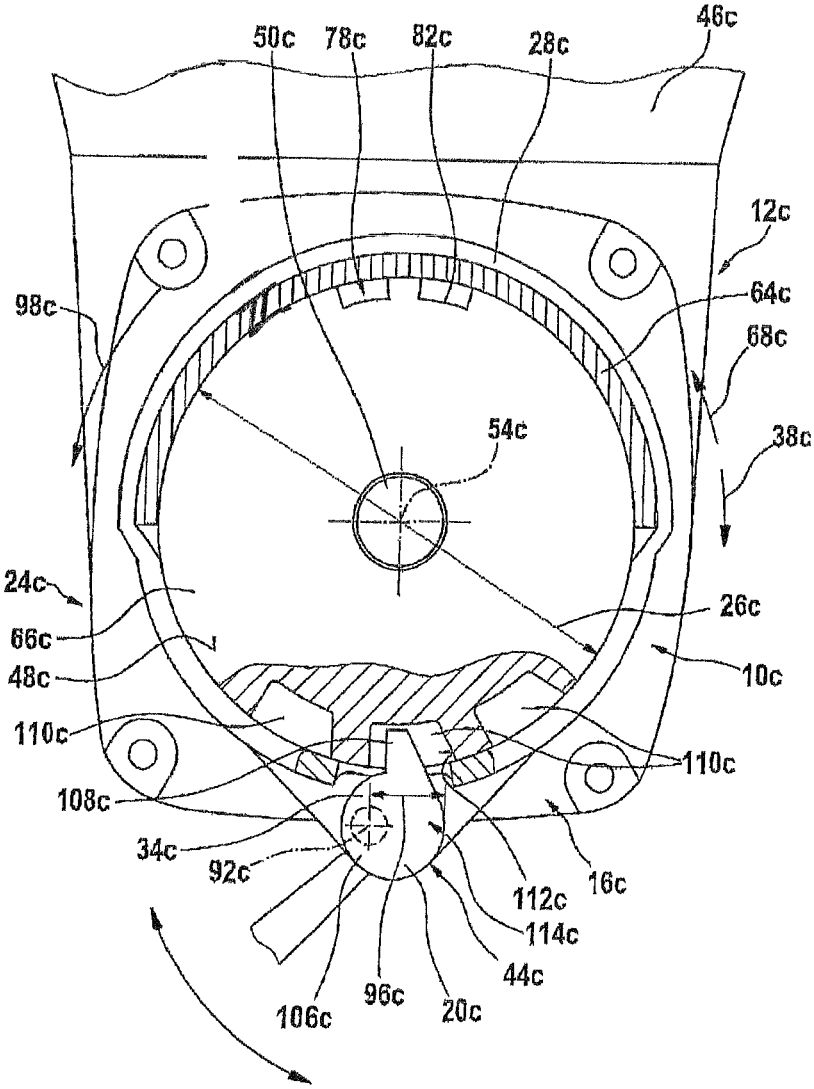
FIG. 4 shows a guard anti-rotation lock device with a non-positive connection element designed as an eccentric element in the region of a closing unit of a guard unit, in a schematic, partial cross-sectional view.

FIG. 4 shows a schematic, partial cross-sectional view of an alternative guard anti-rotation lock device 10*c* of a hand-held power tool system. Guard anti-rotation lock device 10*c* includes a non-positive connection unit 16*c* with a non-positive connection element 20*c*, which is designed as an eccentric element 34*c*, and which is provided to prevent rotation between a hand-held power tool and a guard unit if a tool should burst. Non-positive connection element 20*c* is provided to change a shape parameter—represented by a diameter 26*c*—of a component of the guard unit that is designed as clamping band 28*c*. Non-positive connection element 20*c* is also located on a closing unit 44*c* of the guard unit and, to this end, is designed as a single piece with a clamping closing element 106*c*. Eccentric element 34*c* also includes a hook element 108*c*, which, when the guard unit is in a working position, engages in one of several recesses 110*c* provided in a receiving flange 66*c* of the hand-held power tool in order to receive hook element 108*c*. When the guard unit is moved, together with eccentric element 34*c*, in a rotation direction 98*c* of the tool due to a piece of a burst tool striking the guard unit, hook element 108*c* is pressed against a wall 112*c* of recess 110*c*, eccentric element 34*c* is rotated around rotation axis 92*c*, and a subregion 114*c* of eccentric element 34*c* with a greatest distance 96*c* relative to rotation axis 92*c* is rotated in the direction of receiving flange 66*c*. This brings about a reduction in diameter 26*c* of clamping band 28*c*, which, in turn, results in hook element 108*c* being fixed more securely in position in recess 110*c*. An anti-rotation lock of the guard unit results from the non-positive connection, in a manner similar to that described with reference to FIG. 2.

Figure 4A:
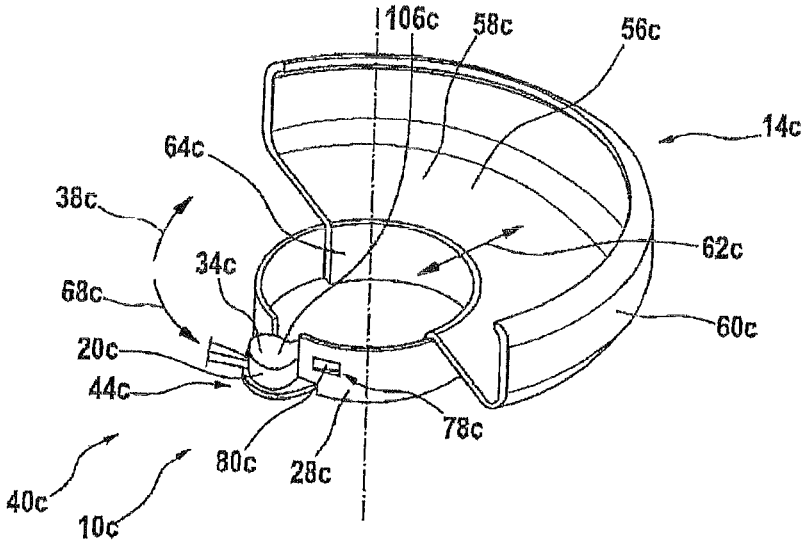
FIG. 4A shows a perspective view of the guard anti-rotation lock device depicted in FIG. 4.

FIG. 4A is presented to provide a perspective view of the guard anti-rotation lock device 10*c* designed to include an eccentric element 34*c* in the region of a closing unit 44*c* of a guard unit, as depicted in FIG. 4

Figure 5:
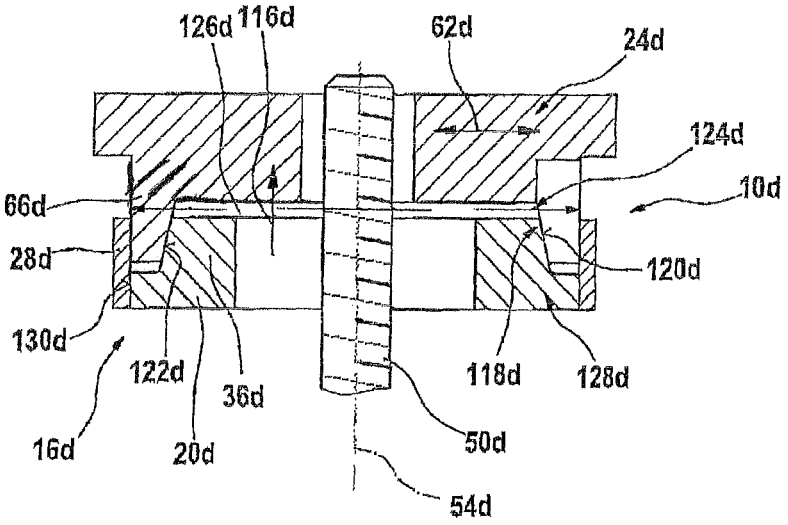
FIG. 5 shows a guard anti-rotation lock device with a non-positive connection element designed as a wedge element, in a schematic, partial cross-sectional view.

FIG. 5 shows an alternative guard anti-rotation lock device 10*b* of a hand-held power tool system, in a schematic, partial cross-sectional view. Guard anti-rotation lock device 10*d* includes a non-positive connection unit 16*d* with a non-positive connection element 20*d*, which is designed as a wedge element 36*d*, and which is provided to prevent rotation between a hand-held power tool and a guard unit if a tool should burst. Wedge element 36*d* is designed such that it tapers conically along a direction 116*d*, which extends essentially perpendicularly to a cross-sectional area of a receiving flange 66*d*, on a region 118*d* that faces receiving flange 66*d*. In this region 118*d*, wedge element 36*d* includes—on a surface 120*d* that faces outwardly in radial direction 62*d*—a not-shown thread, via which wedge element 36*d* is located in a manner such that it may be screwed and unscrewed with a not-shown counter-thread on a surface 122*d*, which is located inwardly in radial direction 62*d*—of receiving flange 66*d*. To this end, receiving flange 66*d* includes a conically tapered recess 126*d* in a region 124*d* that faces inwardly in radial direction 62*d*. Wedge element 36*d* is designed cylindrical in shape in a region 128*d* facing away from receiving flange 66*d*. A diameter of wedge element 36*d* is essentially equal to an outer diameter of receiving flange 66*d*. In cylindrical region 128*d* of wedge element 36*d*, when the guard unit is in an installed working position, a clamping band 28*d* bears against a surface 130*d* that is oriented outwardly in radial direction 62*d*. A frictional force between surface 130*d* of wedge element 36*d* and clamping band 28*d* is greater than a frictional force between receiving flange 66*d* and clamping band 28*d*. If a tool should burst, or if the guard unit rotates in the direction of rotation of the tool, wedge element 36*d* is also rotated, due to a non-positive connection with clamping band 28*d*, and it is rotated into receiving flange 66*d*. A conically tapered design of wedge element 36*d* results in a widening of a cross-sectional area of receiving flange 66*d*, which is designed slotted in the circumferential direction for this purpose, thereby preventing an irreversible deformation of receiving flange 66*d*. An anti-rotation lock of the guard unit results from the non-positive connection, in a manner similar to that described with reference to FIG. 2.

Figure 6A:
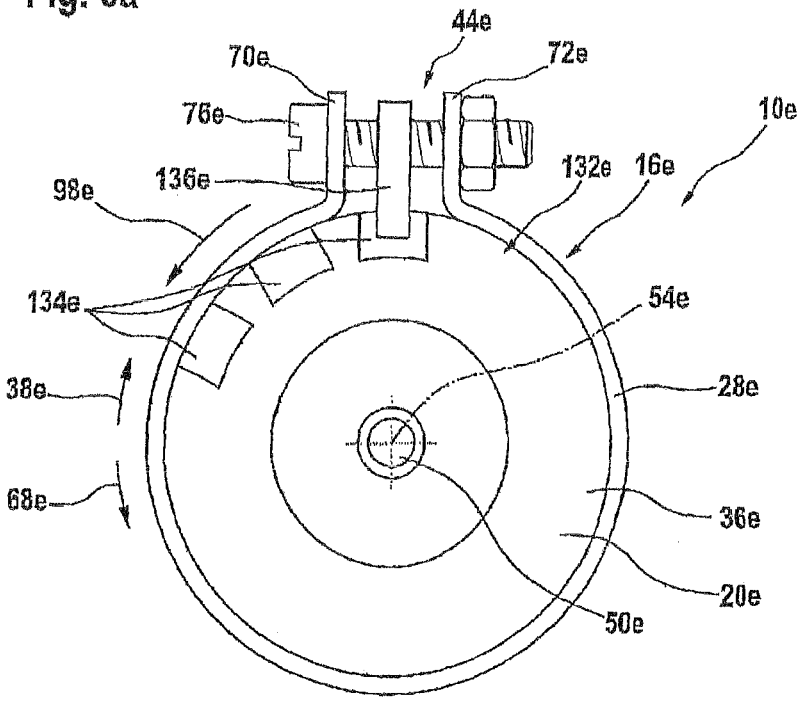
FIGS. 6*a*, 6*b* show a guard anti-rotation lock device with a wedge element having an alternative design to that shown in FIG. 5, in a schematic view from the top (FIG. 6*a*), and in a cross-sectional view (FIG. 6*b*)
Figure 6B:
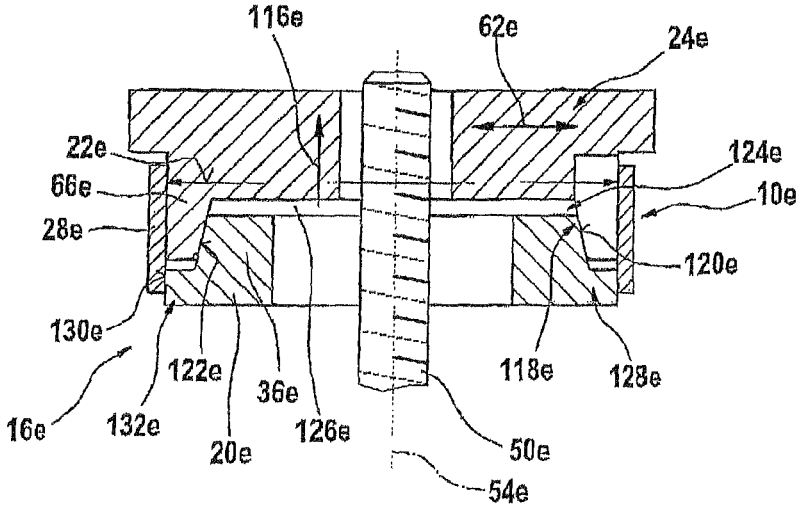

An alternative design of guard anti-rotation lock device 10*e* of a hand-held power tool system is shown in FIGS. 6*a* and 6*b*. Guard anti-rotation lock device 10*e* includes a non-positive connection unit 16*e* with a non-positive connection element 20*e*, which couples to a guard unit in a form-fit manner. To this end, non-positive connection element 20*e* designed as wedge element 36*e* includes—in an outer edge region 132*e* in radial direction 62*e*—a recess 134*e* that extends in circumferential direction 38*e*, 68*e*, in which a form-fit element 136*e* of the guard unit engages. Form-fit element 136*e* is located on a closing unit 44*e* of the guard unit, and it is designed as a tab-type hook element. Form-fit element 136*e* is brought into a form-fit position when the guard unit is attached or when closing unit 44*e* is closed in a non-positive manner using a clamping screw. An anti-rotation lock of the guard unit results from the non-positive connection, in a manner similar to that described with reference to FIG. 5.

Figure 7A:
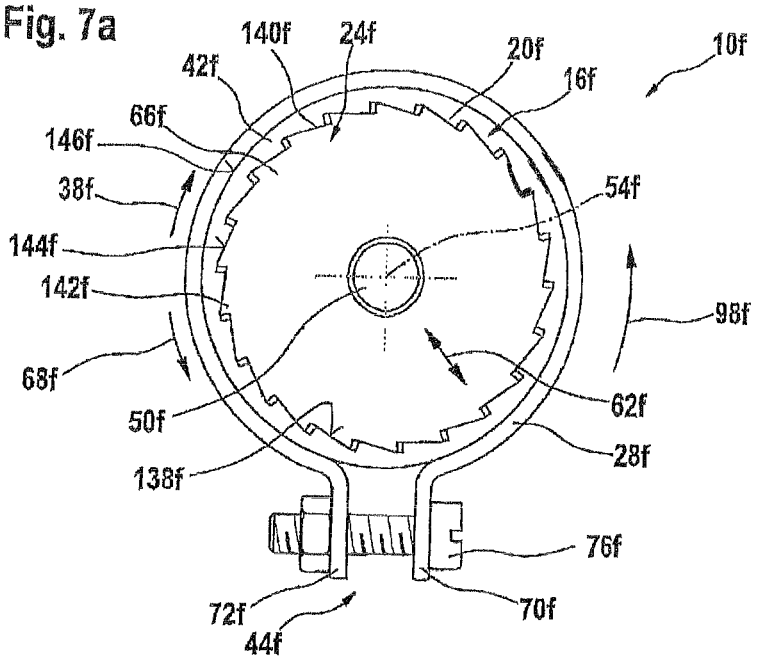
FIGS. 7*a*, 7*b* show a guard anti-rotation lock device with a non-positive connection element designed as an intermediate ring, which is coupled to a guard unit in a non-positive manner (FIG. 7*a*) and in a form-fit manner (FIG. 7*b*), in a schematic, partial cross-sectional view.
Figure 7B:
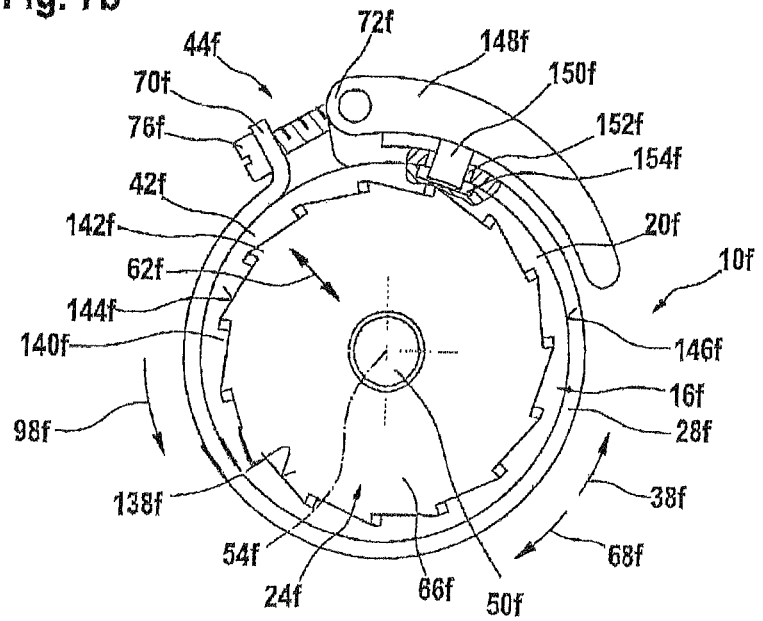

FIGS. 7*a* and 7*b* show a schematic, partial cross-sectional view of an alternative guard anti-rotation lock unit 10*f* of a hand-held power tool system. Guard anti-rotation lock device 10*f* includes a non-positive connection unit 16*f* with a non-positive connection element 20*f*, which is designed as an intermediate ring 42*f*, and which is provided to prevent rotation between a hand-held power tool and a guard unit if a tool should burst. Intermediate ring 42*f* is captively located on a receiving flange 66*f* of a receiving unit 24*f*. Intermediate ring 42*f* is designed in the shape of a ramp in a circumferential direction 38*f*, 68*f* on a surface 138*f* that is oriented inwardly in radial direction 62*f* and faces receiving flange 66*f*. To this end, intermediate ring 42*f* includes ramp elements 140*f* located one after the other in circumferential direction 38*f*, 68*f*, which engage in ramp elements 142*f*—that have the same shape but face in opposite directions—on a surface 144*f*—that is oriented outwardly in radial direction 62*f*—of receiving flange 66*f*. When the guard unit is installed in a working position, a surface 146*f*—that is oriented outwardly in radial direction 62*f*—of intermediate ring 42*f* couples in a non-positive manner with a clamping band 28*f* or a guard collar of the guard unit (FIG. 7*a*). If a tool should burst, or if the guard unit rotates in rotation direction 98*f* of the tool, intermediate ring 42*f* is also rotated, due to a frictional force between clamping band 28*f* and intermediate ring 42*f*, and ramp elements 140*f*, 142*f* of intermediate ring 42*f* and receiving flange 66*f* are displaced toward each other. A diameter of intermediate ring 42*f* is thereby widened, or a cross-sectional area of receiving unit 66*f* enlarges, together with intermediate ring 42*f*, thereby resulting in an effective anti-rotation lock between the guard unit and receiving unit 24*f* due to a non-positive connection similar to that described with reference to FIG. 2.

In FIG. 7*b*, intermediate ring 42*f* couples in a form-fit manner with clamping band 28*f* for driving in a rotary manner if the guard unit should rotate due to a tool bursting. To this end, a closing element 148*f* designed as a clamping lever includes a cam 150*f*, which, in a closed state, extends inwardly on the clamping lever in radial direction 62*f* away from a closing unit 44*f* designed as a toggle joint system. For driving in a form-fit, rotary manner, clamping band 28*f* and intermediate ring 42*f* each include a recess 152*f*, 154*f*, through or in which cam 150*f* engages when the toggle joint system is in the closed state. An anti-rotation lock using intermediate ring 42*f* and a further embodiment of intermediate ring 42*f* is referenced in the description of FIG. 7*a*.

What is claimed is:

1. A system comprising:

a hand-held power tool having a tool housing, a receiving unit fixed to the tool housing, the receiving unit including a drive shaft connectable at a free end to a rotatable tool;

a guard unit connected with the hand-held power tool, the guard unit including a guard extending at least partially around the rotatable tool; and a guard anti-rotation lock device including a clamping band fixedly connected to the guard, the clamping band establishing a frictional connection between the guard unit and the receiving unit to position the guard in a non-rotational manner with respect to the tool housing during hand-held power tool operation, wherein the receiving unit further includes a receiving flange and a connecting element that are together surrounded by and clamped by the clamping band to form a clamping region with a cross sectional area to effect the frictional connection between the guard unit and the receiving unit, wherein the guard anti-rotation lock device is configured to counteract a rotational movement of the guard occurring in a case where a rotating tool bursts and a piece of the burst tool is slung outwardly, strikes the guard and transfers rotational kinetic energy from the striking piece to the guard in an amount sufficient to overcome the friction connection and effect the rotational movement, wherein the rotational movement causes rotation of the connecting element, which connecting element rotation increases the cross-sectional area of the clamping region, and wherein the increased cross-sectional area of the clamping region increases an amount of frictional force imparted by the clamping band on the receiving unit defined by the frictional connection thereby effecting the guard rotational movement counteraction.

2. The system as defined in claim 1, wherein connection element movement increases the cross-sectional shape of the clamping region in accordance with an amount of the movement.

3. The system as defined in claim 1, wherein the connection element is a rolling element.

4. The system as defined in claim 1, wherein the connection element is an eccentric element.

5. The system as defined in claim 1, wherein the connection element is a wedge element.

6. The system as defined in claim 1, wherein said wedge element has a thread for attachment to a receiving unit for receiving the tool of the hand-held power tool.

7. The system as defined in claim 1, wherein the connection element is a ramp.

8. The system as defined in claim 1, wherein the receiving unit is slotted at least partially along a circumferential direction.

9. The system as defined in claim 1, wherein the receiving unit includes an intermediate ring on which the connection element is at least partially located.

10. The system as defined in claim 1, wherein the guard unit includes at least one closing element on which the connection element is at least partially located.

11. The system as defined in claim 1, further comprising a coding device for preventing the rotatable tool together with the guard unit from being installed on the hand-held power tool unintentionally, the coding device comprising a first coding element provided on the receiving unit and a second cooling element provided on the guard unit, wherein the first coding element is engagable with the second coding element only when it corresponds to said second coding element, and vice versa.

* * * * *